US006029574A

United States Patent [19]

Richards

[11] Patent Number: 6,029,574

[45] Date of Patent: Feb. 29, 2000

[54] DUAL INK SUPPLY SYSTEM

[75] Inventor: John Sheridan Richards, Barrington, N.H.

[73] Assignee: Heidelberger Druckmaschinen AG, Heidelberg, Germany

[21] Appl. No.: 09/163,304

[22] Filed: Sep. 30, 1998

[51] Int. Cl.[7] ..... B41F 31/02

[52] U.S. Cl. ..... 101/365; 483/210; 483/211

[58] Field of Search ..... 101/350.1, 363, 101/364, 365, 366, 207, 208, 483, 424.2, 416.1, 417, 491, 210, 211

[56] References Cited

U.S. PATENT DOCUMENTS

| | | | |
|---|---|---|---|
| 3,650,240 | 3/1972 | Russell | 116/114 |
| 4,366,754 | 1/1983 | Sarda | 101/208 |
| 4,552,295 | 11/1985 | Smith et al. | 226/195 |
| 4,796,528 | 1/1989 | Sarazen | 101/207 |
| 5,027,706 | 7/1991 | Niemiro et al. . | |
| 5,566,570 | 10/1996 | Hankel et al. | 73/159 |
| 5,591,796 | 1/1997 | Wisniewski et al. | 524/484 |

*Primary Examiner*—Kimberly L. Asher
*Attorney, Agent, or Firm*—Burns, Doane, Swecker & Mathis, LLP

[57] ABSTRACT

The present invention is directed to preventing image damage caused by pressure applied to print media during a folding process, by using pressure and abrasion resistant inks only on those sections of print media that are subjected to pressures that would otherwise damage the images printed on those sections. Images on other sections of the print media are printed using less expensive or general purpose inks.

23 Claims, 7 Drawing Sheets

DUAL INK SUPPLY SYSTEM

BACKGROUND OF THE INVENTION

1. Field of the Invention

The present invention relates to printing images on media, such as webs of paper, that will be subjected to pressure during inking and/or folding processes.

2. State of the Art

Conventional printing presses print images on media, such as webs, ribbons or signatures, and then fold the printed media. However, folders and rollers used to grip the media and/or set the folds can damage printed images located at and near the folds. This is because the pressure generated on the media by the folders and rollers can cause the ink on the media to rub off onto a folder or roller, and can cause the ink to smear. In addition, the folders and rollers often press an image side of a first print medium against a second print medium, as for example when multiple sheets or ribbons of print media are folded together to form a broadsheet, tabloid, magazine or digest product. The resultant pressure can cause the image on the first print medium to be "set off", or transferred in whole or in part, to the second print medium. This damages the image on the first print medium and any image at the corresponding location on the second print medium.

When multiple colors are to be printed on a print medium, the print medium is sequentially processed by different print units within the printing press. Each print unit uses a different color ink, and supplies the ink or makes the ink available across the entire width of the print medium, for use as necessary in the image to be printed. Some presses are configured with sequential print units that each provide the same color ink (black for example). Sequential print units are typically used to print the same color ink when one of the print units will print black text and the other print unit will print black images or image components. Even in this situation, each of the print units supplies ink or makes ink available across the entire width of the print medium for use as necessary in the image (text or graphic) to be printed.

FIGS. 2–4 show a front view of a folder unit 200 of a conventional web fed printing press. As shown in FIG. 2, a web of print medium 212, such as paper or any other suitable print medium, flows over a former board 202 in the direction 216. The sides of the print medium 212 form corners 214 as they pass over the edges of the former board 202, and a fold or crease is formed at the nose 213 of the former board 202. The sides of the print medium 212 are rotated 90 degrees in the folding process, so that the line 215 represents the folded edge of the print medium 212 as the folded print medium passes through the nips formed by the rollers 204, 206, 208 and 210. The rollers 210 are cutting cylinders for cutting the folded print medium 212 crosswise. Multiple webs, or ribbons of print media cut therefrom, can be simultaneously processed using the folder unit 200, by pulling the webs or ribbons over the former board 202 in multiple layers.

In at least one of the roller sets 206 and 208, each roller is knurled where it contacts the folded edge 215 and the outer edges of print medium 212. The knurling allows the rollers 206, 208 to grip the print medium 212 and pull it over the former board 202 and through the first set of rollers 204.

FIG. 3A shows a side view of the folder unit 200, with the print medium 212. FIG. 3B shows a top view of rollers 306 which can be used in place of either the rollers 206 or 208. Each roller 306 has a center shaft 308, and ends that have a larger diameter than that of the shaft 308. The surfaces 307 of the roller ends are knurled or textured. FIG. 3B also shows how two layered ribbons 312, 313 of print medium that were pulled over the former board 202 are squeezed together at their folded and outer edges. Generally, the more layers of ribbons there are, the greater the pressure the nip must apply to grip and pull the ribbons over the former board 202 and through the nip without having any of the inner layers of ribbons slip and move with respect to the other layers of ribbons.

FIG. 4 shows a side view of another example of a conventional folder unit. The folder unit 400 has two former boards 202 for simultaneously processing two or more two streams of print media, one stream over each former board 202. The nips formed by the rollers 406, 408 and 410 can simultaneously receive both print streams, and are appropriately knurled to grip the folded and outer edges of each print stream.

Images printed on the outer surface of the FIG. 3 print medium 212 or the FIG. 4 print medium 412 can be damaged by rubbing off onto the rollers, and the rubbed off ink can damage subsequent images by later transferring from the rollers onto a subsequent portion of the print medium. In addition, referring to FIG. 3A, images printed on the inner surface of the print medium 312 can be set off onto the outer surface of the print medium 313, thus damaging images on both the inner surface of the print medium 312 and the outer surface of the print medium 313. Images on opposing faces of the inner surface of the print medium 313 can also be set off onto each other or smeared by pressure from the knurled portions 307 of the rollers 306. Pressure exerted by the nose of the former board 202 on webs or ribbons of print media passing over the former board 202 can also damage images on the print media in similar ways.

Some commercially available inks (e.g., the so-called "high performance" inks known to the industry) are resistant to transfer or smearing by pressure and abrasion. These inks have been used to replace lower quality inks in printing units where high quality printing is desired. Although using such inks can reduce or eliminate image damage caused by pressure, such inks are typically expensive. Accordingly, operators using conventional printing presses are forced to choose between expensive, high quality print runs using expensive inks or more cost effective, low quality print runs using less expensive inks.

SUMMARY OF THE INVENTION

The present invention provides a relatively inexpensive solution for preventing image damage caused by pressure applied to print media during a folding process, by selectively applying inks resistant to pressure and abrasion only on those sections of print media that are subjected to pressures and abrasions that would damage images printed with less expensive inks. Images on other sections of the print media are printed using the less expensive inks.

In accordance with an embodiment of the invention, a method for printing images on a print medium to be folded includes providing a first ink along fold regions of the print medium and providing at least a second ink along remaining regions of the print medium, wherein the first ink has different performance characteristics under pressure than the at least second ink.

In accordance with an embodiment of the invention, an ink module in a printing unit of a web fed printing press provides a first ink at zones of a web of print medium that correspond to fold locations of a printed product made using the print medium, and provides a second ink at other zones of the web. The ink module can also provide the first ink at other zones of the web that will be subjected to pressure during the folding process or during other processes subsequent to application of the first ink onto the web.

BRIEF DESCRIPTION OF THE DRAWINGS

Other objects and advantages of the present invention will become apparent to those skilled in the art from the following detailed description of preferred embodiments, when read in conjunction with the accompanying drawings wherein like elements have been designated with like reference numerals and wherein.

DETAILED DESCRIPTION OF THE PREFERRED EMBODIMENTS

Figure 1:
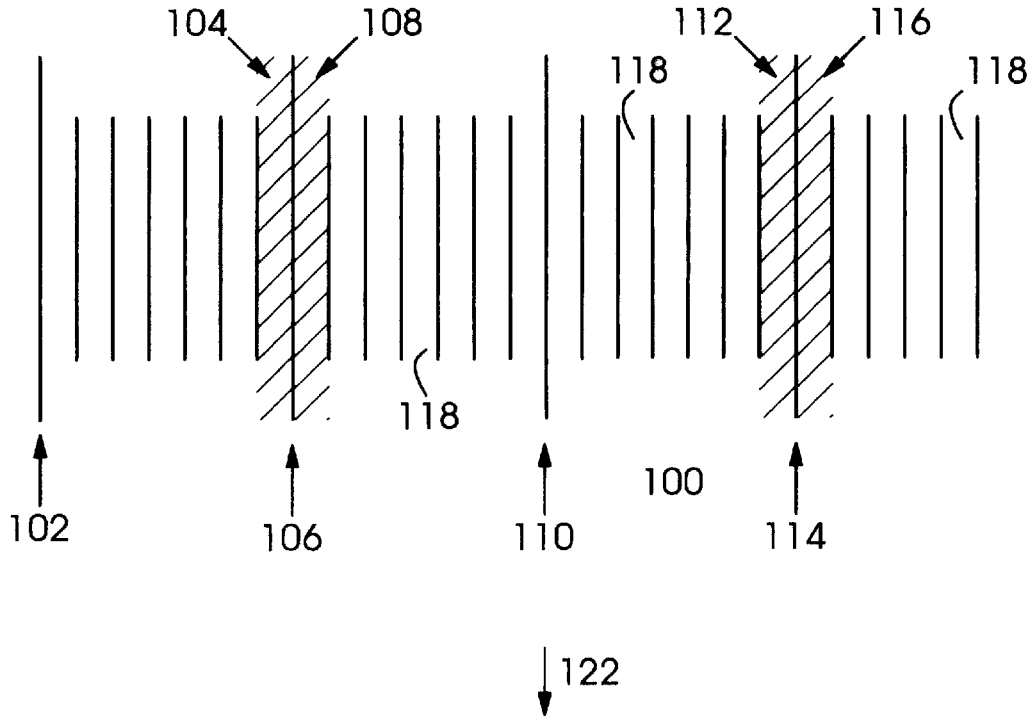
FIG. 1 is a front view of a section of a web of print medium, showing inking zones that correspond to fold points.
Figure 2:
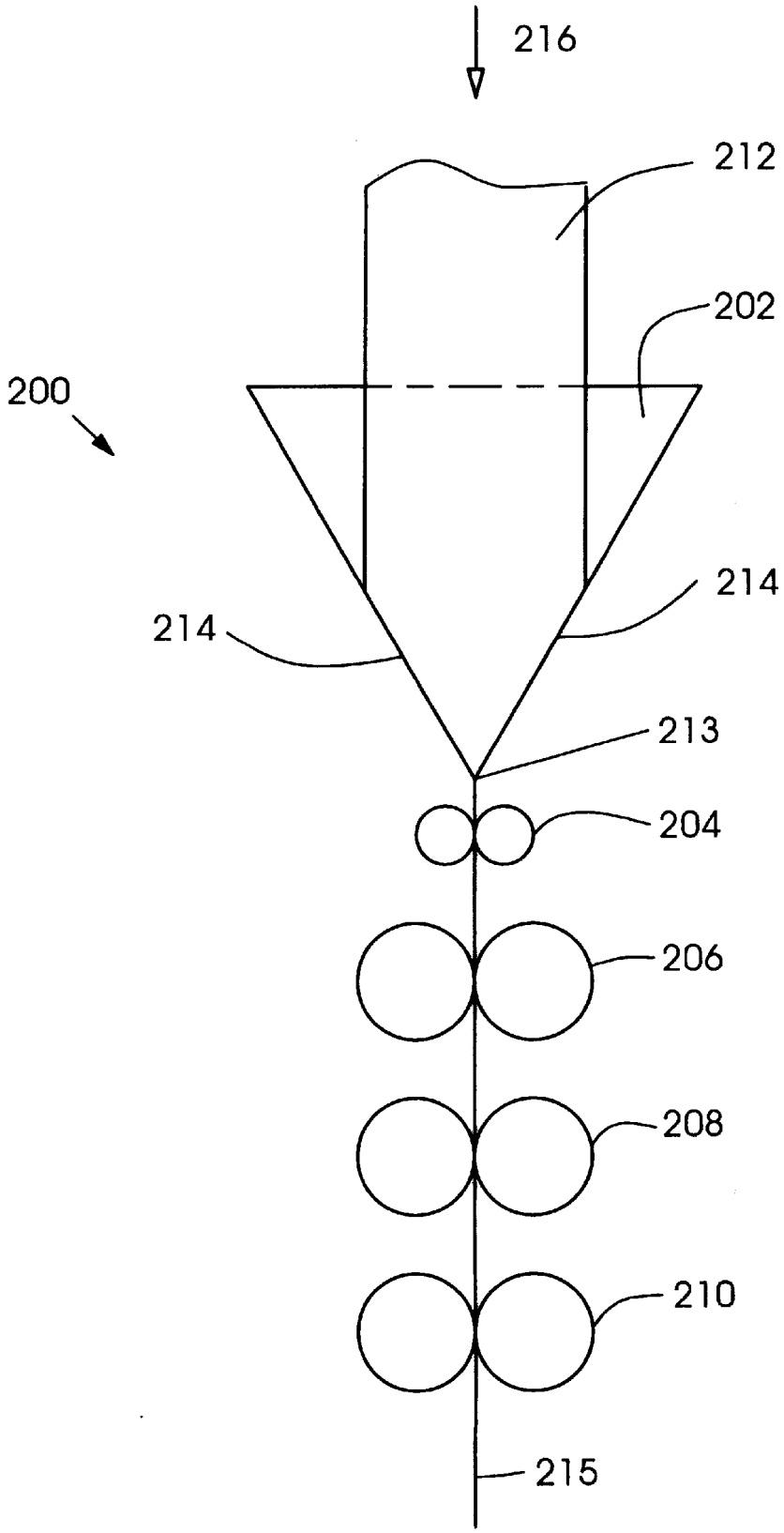
Fig.2 Prior Art
FIG. 2 is a front view of components in a folder unit of a web fed printing press.
Figure 3A:
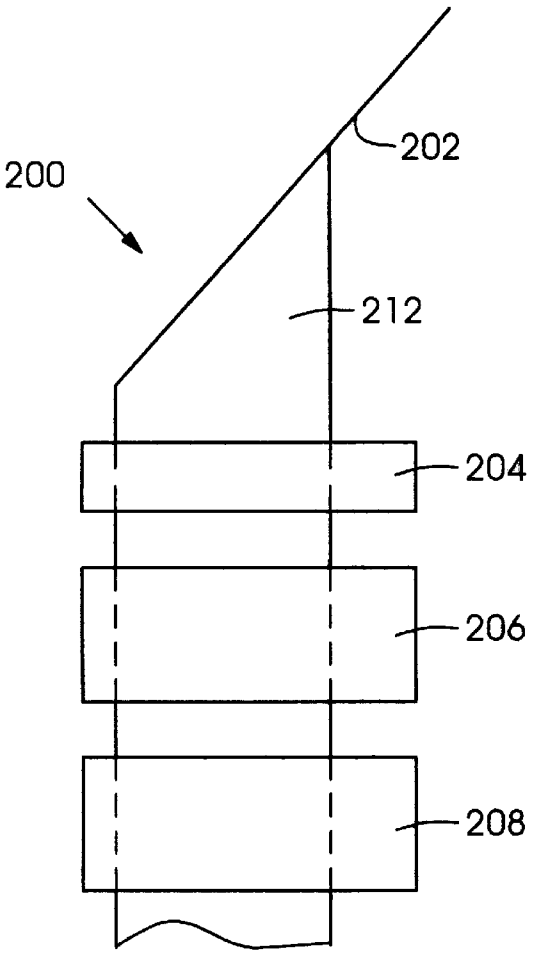
Fig.3A Prior Art
FIG. 3A is a side view of the folder unit components shown in FIG. 2.
Figure 3B:
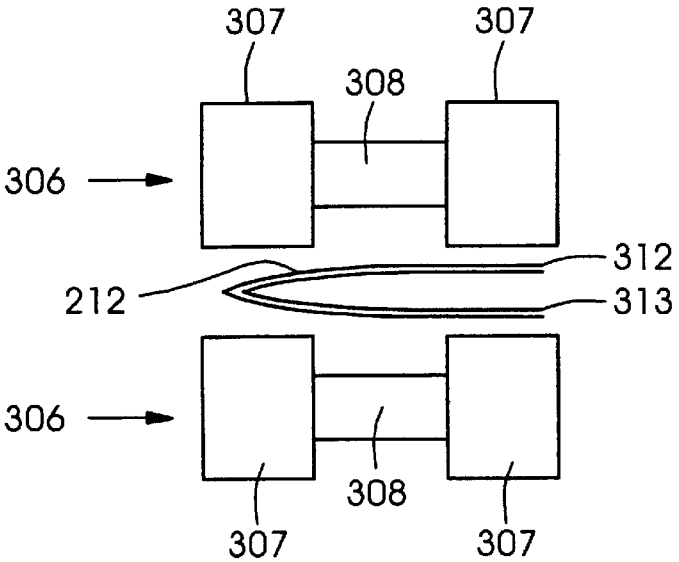
Fig.3B Prior Art
FIG. 3B is a top view of rollers having knurled or textured surfaces which can be used in the folder unit shown in FIG. 2.
Figure 4:
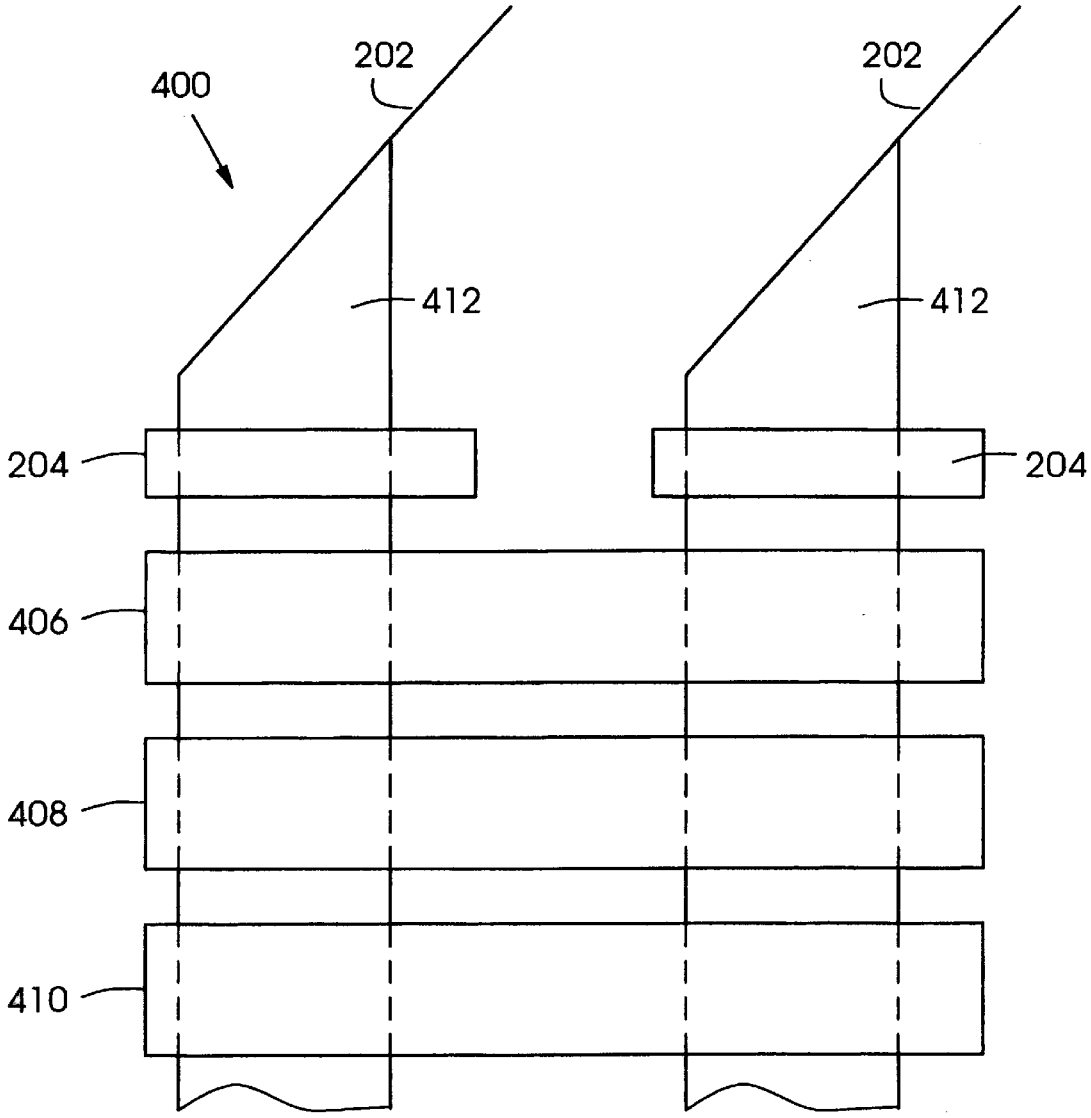
Fig.4 Prior Art
FIG. 4 is a side view of components in a folder unit having a different configuration from that shown in FIG. 3A.

FIG. 1 is a front view of a section of a web of print medium, showing inking zones and fold points wherein inks having different properties have been applied in accordance with exemplary embodiments of the present invention. As shown in FIG. 1, a web 100 is a print medium that is printed in longitudinal zones 118. Subsequently the web is cut along longitudinal line 110 to create two ribbons of print medium. The left hand ribbon is subsequently folded along the line 106, and the right hand ribbon is subsequently folded along the line 114. The zones 104, 108 of the left hand ribbon and the zones 112, 116 of the right hand ribbon will be squeezed as the ribbons pass over a former board such as the former board 202 shown in FIG. 2. The zones 104, 108, 112 and 116 will also be squeezed as they pass through a nip having knurled or textured rollers, as generally shown in FIG. 3B.

In accordance with an embodiment of the invention, a specially formulated ink is applied to the ink zones 104, 108, 112 and 116 shown in FIG. 1, and general purpose inks that are less expensive than the specially formulated ink are applied to the remaining ink zones 118. The specially formulated ink can be pressure and abrasion resistant, so that after it is applied to a print medium to form a desired image, it will not come off or be altered to damage the image when subjected to pressure and abrasion during the printing and folding processes. In other words, the specially formulated ink has superior performance characteristics under pressure, for example enhanced resistance to setoff, smearing, abrasion and rubbing off.

For example, embodiments of the present invention can use commercial inks manufactured and sold by Sun Chemical, a division of the U.S. Ink company, or any other available inks. Sun Chemical manufactures at least the following grades of ink, listed in order from least expensive with lowest pressure/abrasion performance, to most expensive with highest pressure/abrasion performance; Standard web offset ink, Super Standard web offset ink, Low Rub web offset ink, and Rubpruf web offset ink.

Figure 5:
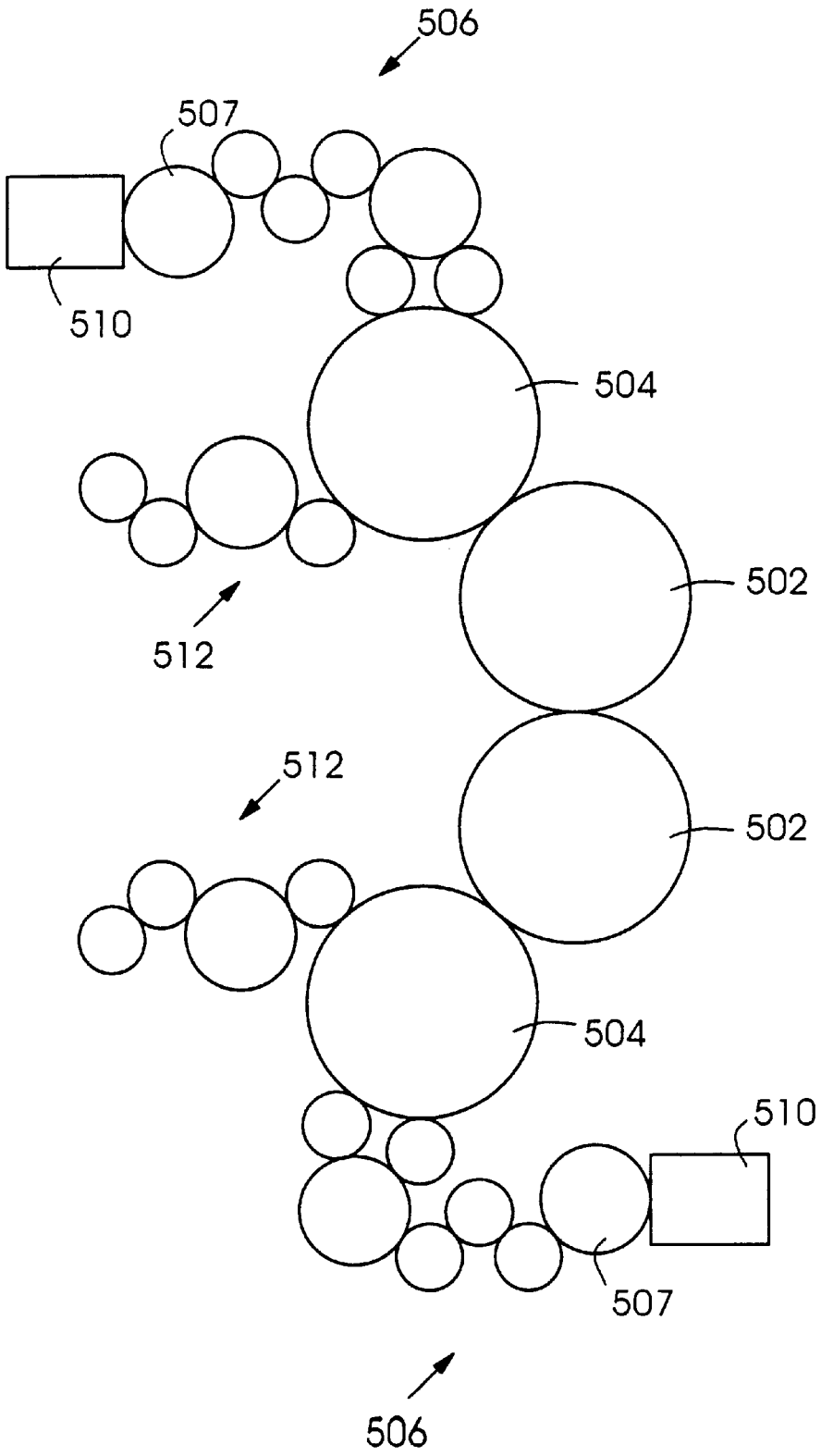
FIG. 5 is a side view of an inking assembly for use in an offset web fed printing press in accordance with an embodiment of the invention.

FIG. 5 shows a side view of an inking assembly for use in an offset web fed printing press in accordance with an embodiment of the invention. A web of print medium (not shown) passes between the blanket rollers 502, and receives an image from the blanket rollers 502. The plate rollers 504 have the images to be printed, and are supplied with water by the dampening rollers 512, while ink trains 506 of ink rollers supply ink to the plate rollers 504. As is well known in the art, the water displaces the ink at specific locations on the plate rollers 504, so that ink on the remaining locations of the plate rollers 504 represents the image to be printed. One or more ink modules 510 in accordance with an embodiment of the invention supply the ink rollers 507 with ink, as shown in FIG. 5.

Figure 6:
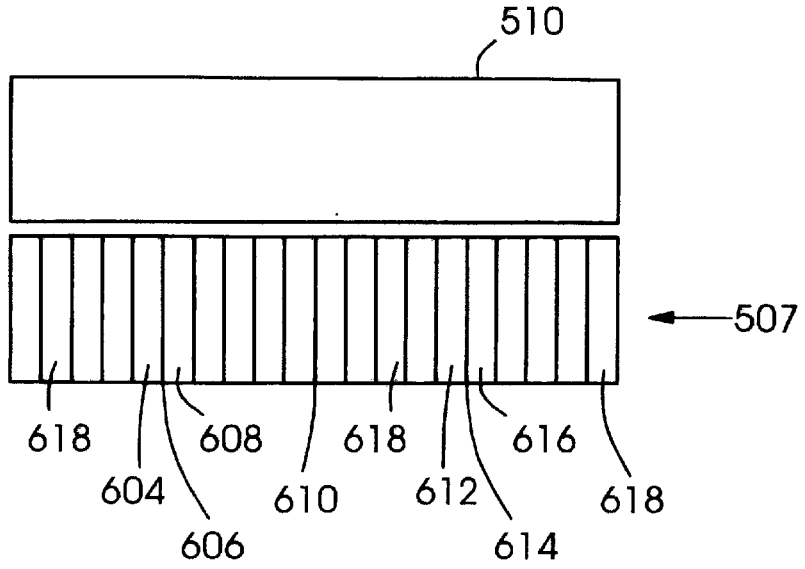
FIG. 6 is a top view of an ink module and an ink roller in accordance with an embodiment of the invention.

As shown in FIG. 6, the ink module 510 provides a specially formulated, pressure resistant ink at ink zones 604, 608, 612 and 616 where those ink zones correspond to sections of a web of the print medium near fold points. The boundaries 606 and 614 between the ink zones 604 and 608, and 612 and 616 correspond to fold points of the web of the print medium, and the boundary 610 corresponds to a line along which the web of the print medium will be cut to form two ribbons. The ink zones 618 correspond to the remaining ink zones, where one or more general purpose inks are used. The ink module 510 can include subunits, wherein the subunits correspond to different inks and/or different ink zones.

In an embodiment of the invention, the ink module 510 can include a system such as that disclosed in U.S. Pat. No. 5,027,706 to Niemiro, et al., (hereafter "Niemiro") which has individual ink injectors for each ink zone. The ink injectors include positive displacement ink pumps. In accordance with an embodiment of the present invention, the system disclosed in Niemiro can be modified so that different ink pumps and injectors are supplied with different inks, so that the fold point ink zones 604 and 608, and 612 and 616 are supplied with a specially formulated ink, such as a pressure resistant ink, and the ink zones 618 are supplied with general purpose inks. The Niemiro patent is hereby incorporated by reference in its entirety.

Figure 7:
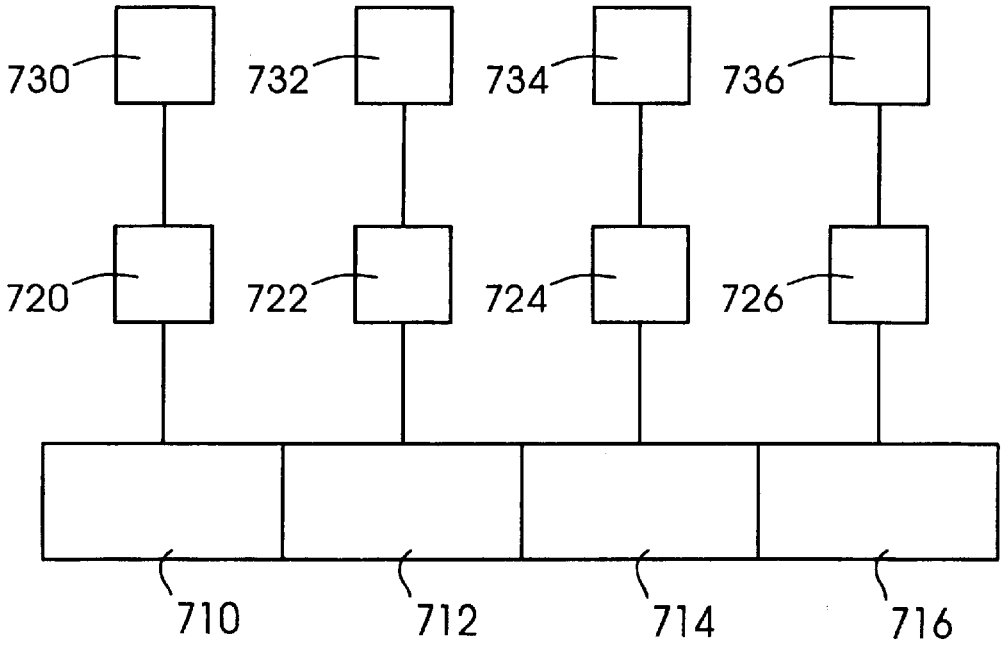
FIG. 7 shows an ink injector assembly in accordance with an embodiment of the invention.

FIG. 7 shows ink injector assemblies in accordance with an embodiment of the invention. The ink reservoirs 730–736 provide ink to corresponding pumps 720–726, and the pumps 720–726 provide the ink under pressure to the injectors 710–716. Each of the ink reservoirs 730–736 can contain a different kind of ink, so when each of the injectors 710–716 corresponds to an ink zone, each ink zone can be provided with a different ink.

In another embodiment of the invention, the ink module 510 can include an "open fountain" ink delivery system that is known in the art, where a roller rotates its circumferential surfaces through baths of ink to pick up a film of ink on the circumferential surfaces. Different baths containing different inks can be provided for different ink zones of the roller, so that each ink zone of the roller picks up an appropriate type of ink. Blades or "keys" corresponding to different ink zones can also be placed at prescribed distances from the roller to modulate the ink film thickness on the roller at each key zone, to control the ink flow so that an appropriate amount of ink is delivered. Such keys for use with a roller having a single ink across its length are known in the art, and are adjusted based on such factors as ink viscosity, ink density, image density or image coverage, absorbency of the print medium, etc. In this application, some of the keys are used with different inks, and are therefore further adjusted according to the individual properties of the corresponding inks.

Figure 8:
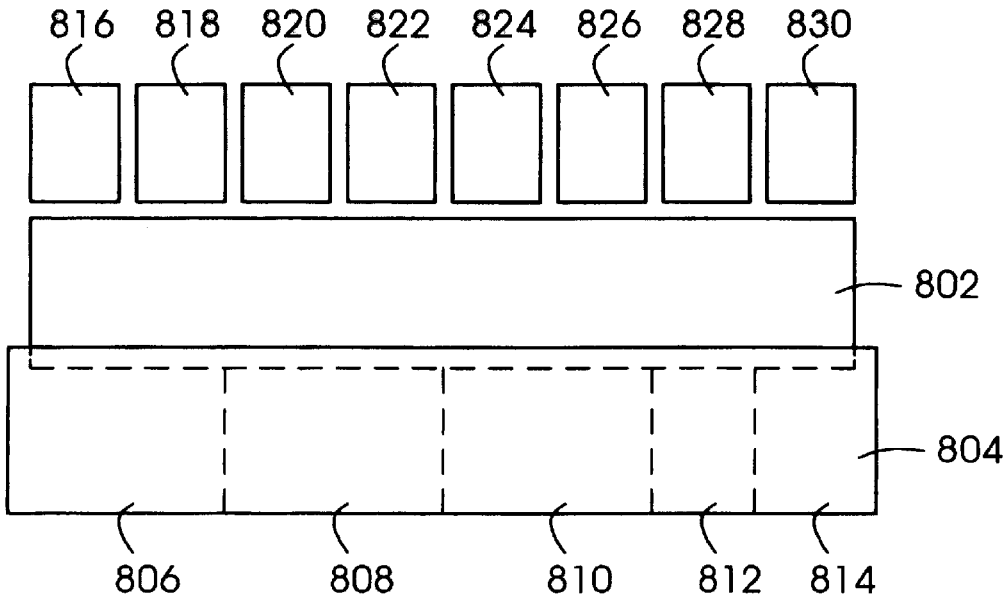
FIG. 8 shows a split fountain in accordance with an embodiment of the invention.

FIG. 8 shows, for example, a split fountain ink assembly in accordance with an embodiment of the invention. The ink fountain 804 is split into different troughs or sections 806–814. As the ink roller 802 rotates, it picks up ink from the troughs 806–814. Ink keys 816–830 modulate ink film thicknesses along the circumferential surface of the ink roller 802. Since each of the troughs 806–814 can contain a different ink, corresponding to different ink zones on the ink roller 802.

Characteristics of the inks can be programmed into the printing press, so that during a preset operation an operator can simply select different inks for different ink zones, and the ink injectors or keys will automatically be adjusted according to the known characteristics of the selected inks.

As those skilled in the art will appreciate, other ink delivery systems that can be adapted to supply different inks to different ink zones can be used with embodiments of the invention. In addition, embodiments of the invention can be used with different kinds of printing presses, including but not limited to offset web fed printing presses.

In accordance with an embodiment of the invention, the different inks for ink zones corresponding to fold points can be applied to a print medium at the same time (subject to practical limitations) and at substantially the same place on the print medium, for example at adjacent locations of different ink zones. In this embodiment, the different inks can be provided and applied to the print medium within the same printing unit.

Figure 9:
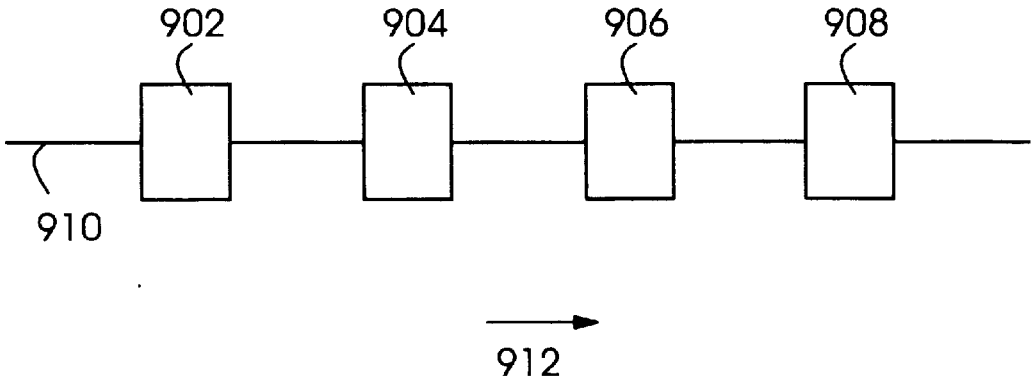
FIG. 9 shows an embodiment of the invention having multiple printing units.

In another embodiment of the invention, the different inks that vary according to physical properties such as durability, pressure resistance, abrasion resistance, and the like, can be provided and applied to the print medium using different printing units, where the print medium (such as a web of paper) passes sequentially through the different printing units. In this embodiment, each printing unit provides a single ink only to specific ink zones. For example, a first printing unit can supply a specially formulated ink to ink zones that correspond to fold points of the print medium, and a second printing unit can supply a different ink, that is for example less durable and less expensive, to ink zones that do not correspond to fold points of the print medium. This embodiment is illustrated in FIG. 9, which shows a print medium 910 passing sequentially through printing units 902–908 in the direction 912.

The first printing unit 902 can supply a specially formulated ink to ink zones that correspond to fold points of the print medium 912, and the second printing unit can supply a different ink to ink zones that do not correspond to fold points of the print medium 912. A set of printing units can also be provided for each color to be printed. For example, the inks supplied by the printing units 902 and 904 can have a first color, such as black, and the other printing units 906 and 908 can respectively supply a specially formulated ink and a conventional ink in a similar fashion, where the inks supplied by the printing units 906 and 908 have a different color such as cyan. Ink modules in each of the printing units 902–908 can be configured to provide only one type of ink for each printing unit. For example, where a printing unit's ink module uses a series of injectors of the type shown in FIG. 7, ink reservoirs corresponding to ink zones for which the printing unit will provide ink can be filled with the same ink. Ink reservoirs, pumps and injectors corresponding to ink zones for which the printing unit will not provide ink, can remain empty and/or disabled. Where the printing unit incorporates an ink module having an ink fountain like that shown in FIG. 8, troughs for ink zones where the printing unit will provide ink can be filled with the same ink, and troughs corresponding to ink zones where the printing unit will not provide ink can remain empty.

It will be appreciated by those skilled in the art that the present invention can be embodied in other specific forms without departing from the spirit or essential characteristics thereof, and that the invention is not limited to the specific embodiments described herein. The presently disclosed embodiments are therefore considered in all respects to be illustrative and not restrictive. The scope of the invention is indicated by the appended claims rather than the foregoing description, and all changes that come within the meaning and range and equivalents thereof are intended to be embraced therein.

What is claimed is:

1. A method for printing images on a print medium to be folded, comprising:

providing a first ink along fold regions of the print medium; and providing at least a second ink along remaining regions of the print medium;

wherein the first ink has different performance characteristics under pressure than the at least second ink.

2. The method of claim 1, wherein the first ink has a greater resistance to set off under pressure than the at least second ink.

3. The method of claim 1, wherein the first ink has a greater resistance to abrasion than the at least second ink.

4. The method of claim 1, wherein the first and the at least second inks are the same color.

5. The method of claim 1, wherein the first and at least second inks are provided at substantially the same time.

6. The method of claim 1, wherein the first and at least second inks are provided at substantially the same location.

7. The method of claim 1, wherein the first ink has a greater resistance to smear than the at least second ink.

8. The method of claim 1, wherein the print medium is a web, and the regions are longitudinal along the length of the web.

9. The method of claim 1, further comprising a step of selecting different inks based on a width of the print medium and printing process requirements.

10. A method for printing images on a print medium, comprising:

providing a first ink along regions of the print medium that are to be subjected to a first pressure; and providing a second ink along regions of the print medium which are to be subjected to a second pressure that is less than the first pressure.

11. The method of claim 10, wherein the pressures are applied during at least one of printing and folding processes.

12. The method of claim 10, wherein the pressure will not damage a first image printed using the first ink when the pressure is applied to the first image, and the pressure will damage a second image printed using the second ink when the pressure is applied to the second image.

13. An ink module for use in a printing press, comprising:

a first plurality of subunits for supplying a first ink;

a second plurality of subunits for supplying at least a second ink;

wherein each of the first plurality of subunits corresponds to one of a plurality of fold regions and gripping regions of a print medium, and each of the second plurality of subunits corresponds to one of a plurality of non-fold regions of the print medium.

14. The ink module of claim 13, wherein the print medium is a web and the regions are longitudinal along the web.

15. The ink module of claim 13, wherein the ink module includes split ink fountains.

16. The ink module of claim 15, wherein each subunit corresponds to an ink fountain.

17. The ink module of claim 13, wherein each subunit corresponds to an ink injector assembly.

18. The ink module of claim 13, wherein the first ink has a greater resistance to set off under pressure than the at least second ink.

19. The ink module of claim 13, wherein the first ink has a greater resistance to abrasion than the at least second ink.

20. The ink module of claim 13, wherein the first and at least second inks are provided at substantially the same time.

21. A printing press for printing images on a print medium using inks of at least a first and second type, comprising:

a plurality of ink modules; wherein a first one of the ink modules provides an ink of the first type to ink zones on the print medium that correspond to fold points; and a second one of the ink modules provides an ink of the second type to ink zones on the print medium that do not correspond to fold points.

22. The printing press of claim 21, wherein the first ink type provides a more durable image than the second ink type.

23. The printing press of claim 21, further comprising a plurality of printing units through which the print medium sequentially passes, wherein a first one of the printing units includes the first ink module, and a second one of the printing units includes the second ink module.

* * * * *